United States Patent [19]

Keith

[11] Patent Number: 4,819,459

[45] Date of Patent: Apr. 11, 1989

[54] FRONT LOADING CLEANING MACHINE

[76] Inventor: John R. Keith, 1845 Fay Dr., Parma, Ohio 44134

[21] Appl. No.: 234,279

[22] Filed: Aug. 19, 1988

[51] Int. Cl.[4] ..... D06F 37/20

[52] U.S. Cl. ..... 68/3 R; 312/251

[58] Field of Search ..... 68/3 R, 210; 312/251, 312/249; 248/672

[56] References Cited

U.S. PATENT DOCUMENTS

| | | | |
|---|---|---|---|
| 1,809,736 | 6/1931 | Speidel | 68/210 X |
| 2,428,489 | 10/1947 | Goodreau | 68/210 |
| 2,575,673 | 11/1951 | Miller . | |
| 2,931,505 | 4/1960 | Winslow . | |
| 2,989,966 | 6/1961 | Marshall . | |
| 3,498,089 | 3/1970 | Miller et al. | 68/210 X |
| 4,307,588 | 12/1981 | Smith et al. | 68/3 R X |
| 4,526,020 | 7/1985 | Fey et al. | 68/3 R |
| 4,534,188 | 8/1985 | Fey . | |
| 4,535,610 | 8/1985 | Fey et al. . | |
| 4,785,643 | 11/1988 | Werner | 68/3 R |

FOREIGN PATENT DOCUMENTS

| | | | |
|---|---|---|---|
| 958546 | 9/1982 | U.S.S.R. | 68/210 |

*Primary Examiner*—Frankie L. Stinson

*Attorney, Agent, or Firm*—Pearne, Gordon, McCoy & Granger

[57] ABSTRACT

A front loading cleaning machine may be operated in a normal manner by opening the front door and loading clothes to be washed. When servicing is required, the entire unit may be tipped forwardly about 90 degrees so that the front door is next to the floor. This makes the rear of the machine unit uppermost and exposes the drive mechanism mounted thereon. The drive mechanism may then be readily serviced because the mechanically moving parts are exposed on the upper portion of this machine unit. After servicing, the machine may readily be tipped back to its upright position, ready for normal operation. The foregoing abstract is merely a resume of one general application, is not a complete discussion of all principles of operation or applications, and is not to be construed as a limitation on the scope of the claimed subject matter.

20 Claims, 4 Drawing Sheets

FRONT LOADING CLEANING MACHINE

BACKGROUND OF THE INVENTION

Washing machines or cleaning machines using water or dry cleaning fluid have been constructed in a number of different forms, and U.S. Pat. No. 2,931,505 illustrates a type of construction often used in commercial laundry equipment with a horizontal axis, rotating perforated container, and a vertical front loading door. U.S. Pat. No. 2,575,673 illustrates a similar type of cleaning machine which is capable of end discharging the washed clothing by tilting upwardly the rear of the machine about ten degrees. U.S. Pat. Nos. 4,534,188 and 4,535,610 illustrate a home laundry type of washing machine which has a vertical axis rotatable perforated basket and a top loading hatch which is accessible by tilting the washing machine forwardly about thirty degrees.

All such machines give little thought to the accessibility of the machine parts for servicing. In a commercial laundry setup with a long row of side-by-side washing machines, the servicing of the drive mechanism at the rear of the horizontal axis rotating perforated tubs is extremely difficult. Similarly, with a stackable unit with a dryer stacked on top of the washing machine, or with an undercounter washing machine, the servicing of the drive mechanism is quite difficult.

SUMMARY OF THE INVENTION

The problem to be solved, therefore, is how to provide easier access to the drive mechanism of a cleaning machine.

This problem is solved by a front loading cleaning machine comprising, in combination, a base adapted to be stationary, a cleaning machine unit having a watertight outer container, a perforated container within said outer container, means journaling said perforated container in said outer container, a front loading door on said outer container providing access to the interior of said perforated container, a drive mechanism including an electric motor and a drive connection from said motor to rotate said perforated container, and a pivot connection between said base and said cleaning machine unit along a horizontal pivot line parallel to the front door of said unit, whereby said unit may be tipped from a substantially vertical position of said front door forwardly to a substantially horizontal position of said front door to thus expose said drive mechanism on an upper portion of said unit.

Accordingly, an object of the invention is to provide a front loading cleaning machine which may be tipped forwardly to expose the drive mechanism.

Another object of the invention is to provide a front loading cleaning machine which has a drive mechanism at the rear and which machine may be tipped forwardly to have the drive mechanism at the upper portion of the machine for easy service.

Other objects and a fuller understanding of the invention may be had by referring to the following description and claims, taken in conjunction with the accompanying drawing.

DESCRIPTION OF THE PREFERRED EMBODIMENTS

Figure 1:
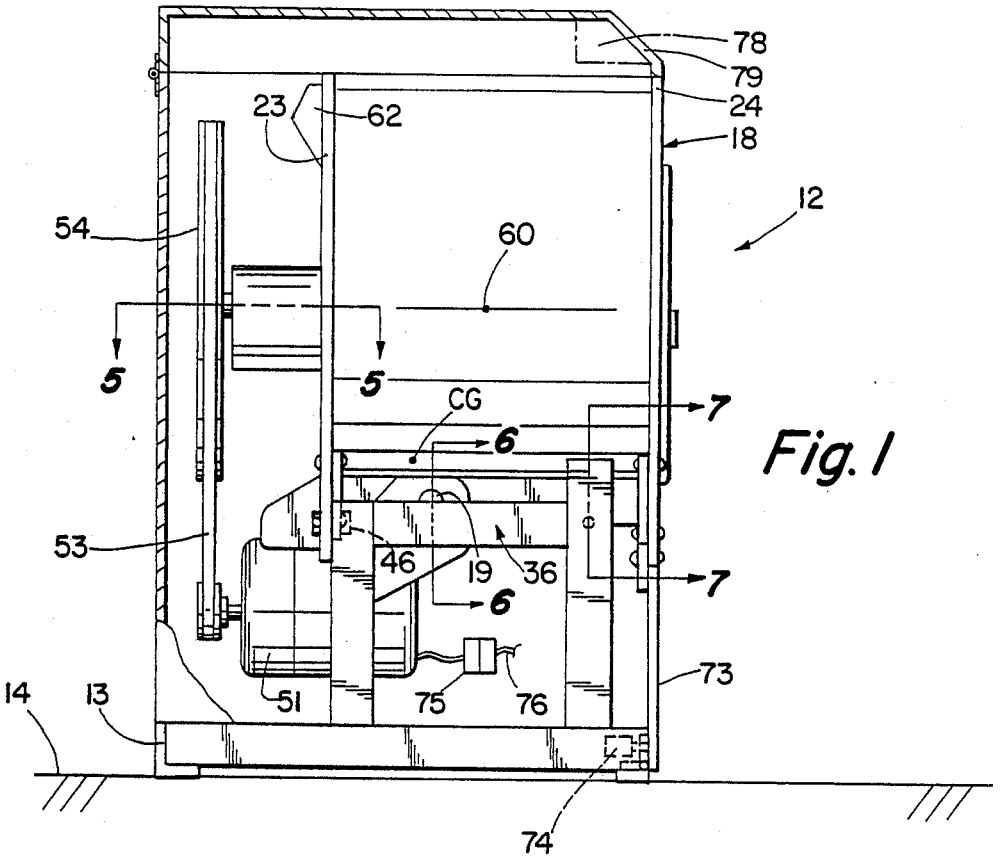
FIG. 1 is a side elevational view of a cleaning machine embodying the invention.
Figure 2:
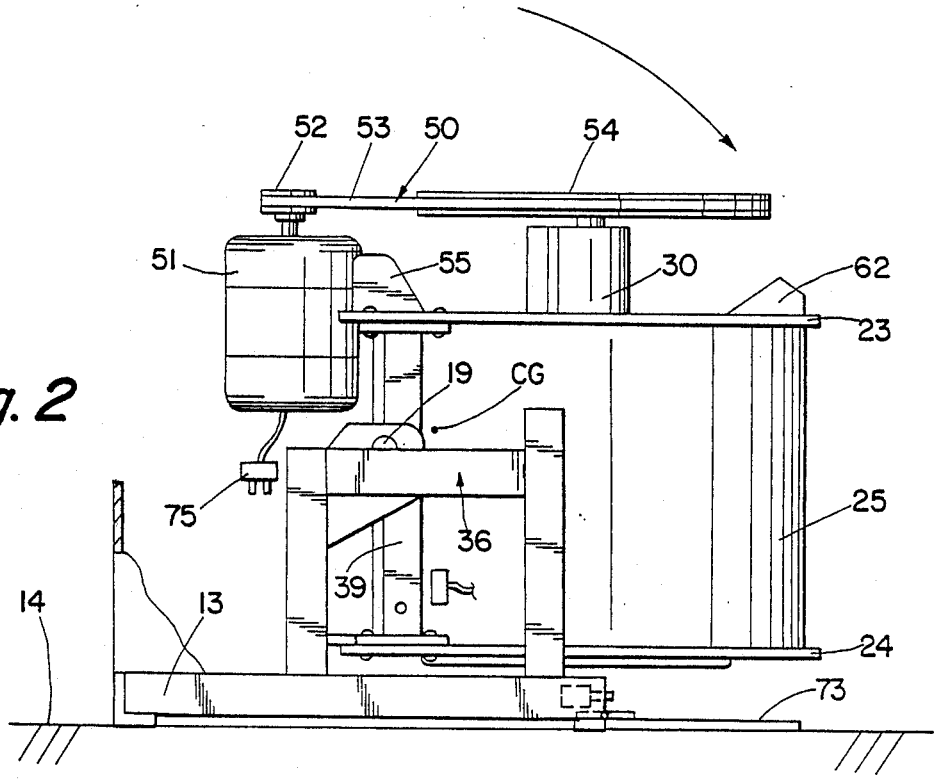
FIG. 2 is a similar side elevational view with the machine tipped forwardly to a servicing position.

FIGS. 1, 2, 3, and 4 generally illustrate a front loading cleaning machine 12 which may be used with water as a washing machine or with dry cleaning fluid as a dry cleaning machine. The machine 12 includes a base 13 which is adapted to be mounted stationarily on a support such as a floor 14. An optional cabinet 15 is shown in FIGS. 1 and 2 as one example of an enclosure which may be used with the washing machine 12. This cabinet has an open front to disclose the front of the machine 12.

A cleaning machine unit 18 is mounted on said base 13 by means of pivots 19 and 20 which are disposed along a horizontal pivot line parallel to the front of the machine 12. This cleaning machine unit 18 is shown upright in FIG. 1 in the operative position, and is shown tipped forwardly about 90 degrees in FIG. 2 to a servicing position.

Figure 4:
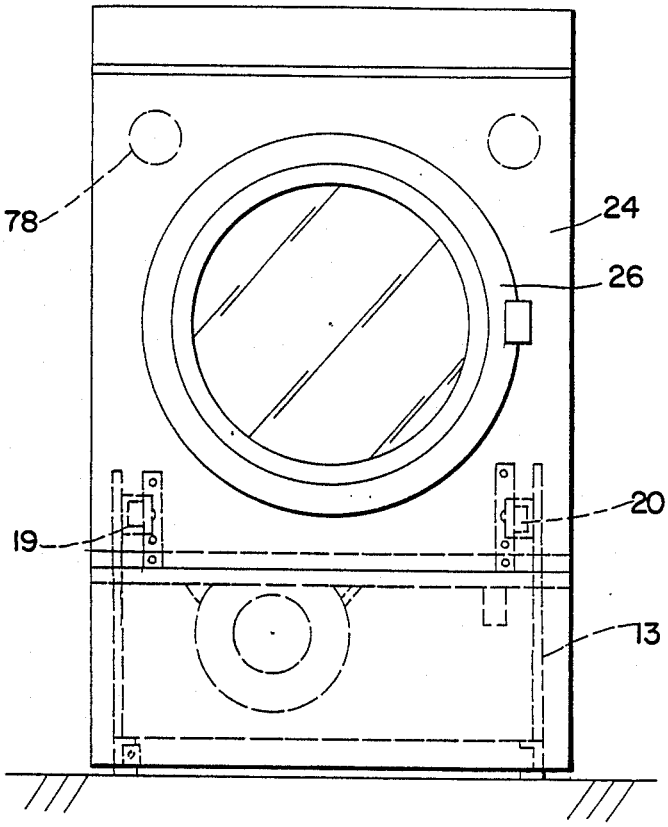
FIG. 4 is a front elevational view of the machine.

The cleaning machine unit includes a rear plate 23, a front plate 24, and an outer container 25 therebetween. A front door 26, FIG. 4, is hinged to the front plate 24 and, when closed, is made watertight to provide watertightness to the outer container. The opening of the front door 26 provides access to the interior for loading clothing and the like to be washed. The outer container may be one of a number of shapes, e.g., octagonal, but is shown as cylindrical.

Figure 5:
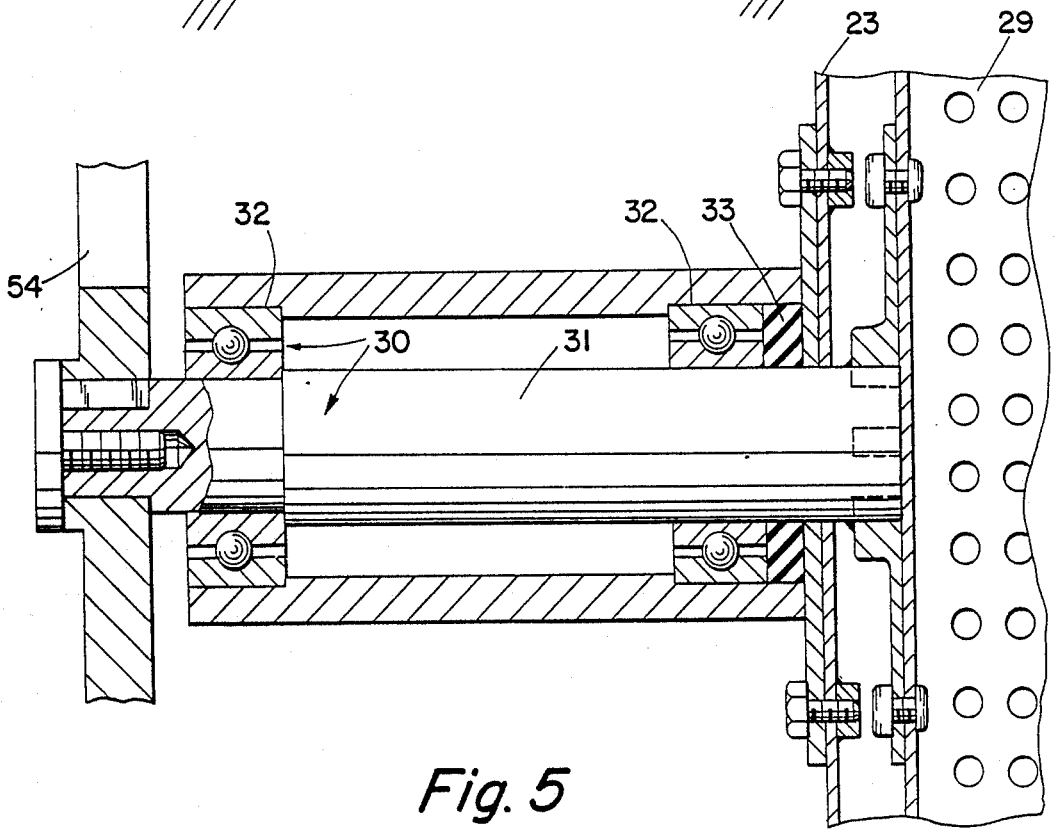
FIG. 5 is an enlarged, sectional view on line 5—5 of FIG. 1.

A perforated container 29, FIG. 5, is contained within the outer container 25. Journal means 30 is provided to journal the perforated container within the outer container 25, and this journal means includes a stub shaft 31 fixed to the rear of the perforated container 29 and a bearing housing 30 fixed to the rear plate 23. A shaft seal 33 is used to maintain separation of the bearings from the cleaning fluid in the washing machine unit.

Figure 6:
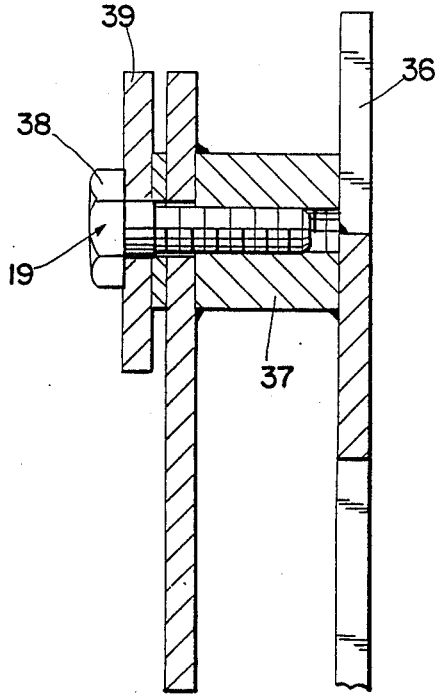
FIG. 6 is an enlarged, sectional view on line 6—6 of FIG. 1.
Figure 7:
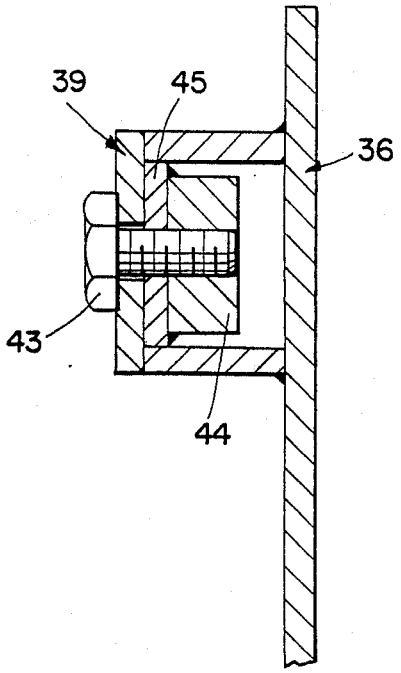
FIG. 7 is an enlarged, sectional view on line 7—7 of FIG. 1.
Figure 8:
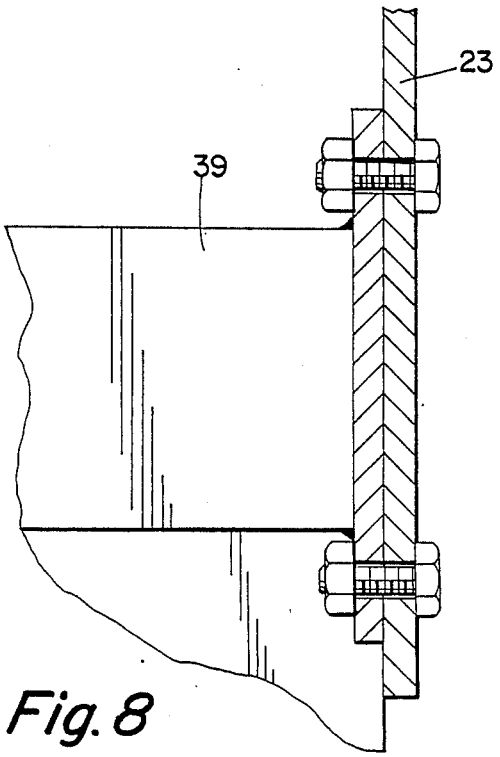
FIG. 8 is an enlarged, sectional view on line 8—8 of FIG. 3.

In FIG. 6, the base 13 has an upright frame 36 to which a nut 37 is secured, as by welding. A shoulder bolt 38 passes through an aperture in a bracket 39 on the cleaning machine unit and is threaded into the nut 37 to form the pivot 19. Pivot 30, FIG. 4, has a similar but reversed construction. FIG. 7 shows a removable bolt 43 which may be threaded into a nut 44 secured to the frame 36. The bolt 43 passes through the bracket 39 secured on the cleaning machine unit 18 and through bracket 45 secured to the base 13, and into nut 44. A similar bolt 43 is provided near the front on the opposite side. Removable bolts 46, one on each side at the rear, secure the machine unit 18 to the frame 13. With these bolts 43 and 46 in place, the cleaning machine unit 18 is locked in the position shown in FIG. 1, and with removal of these bolts 43 and 46, the cleaning machine unit may be tipped forwardly to the position shown in FIG. 2.

A drive mechanism 50, FIG. 2, is provided for the cleaning machine 12, and includes an electric motor 51, a drive pulley 52 on the motor, and a belt 53 to a driven pulley 54 fixed to the stub shaft 31. The motor is mounted in a position conveniently in the lower end of the cabinet to provide a lower center of gravity CG to the cleaning machine unit 18. In this preferred embodiment, the motor 51 is secured by a bracket 55 to the rear plate 23. The center of gravity 60, FIG. 1, of the perforated container 29 is along a centerline of the shaft 31, and hence is above and forward of the pivots 19 and 20. When the perforated container contains wet clothing, for example, then the combined center of gravity moves downwardly but still remains forward and above the pivots 19 and 20. The motor 51 may be a two-speed motor, with a lower speed for washing or cleaning and a higher speed for centrifugally extracting liquid through the perforated container 29 to the outer container 25 and out through a drain 57, FIG. 3. Also, the motor 51 may be a reversible motor to rotate in a first direction for a short time and then rotate in the opposite direction for a similar time period for washing. The rear plate 23 is also provided with an overflow 58 and an air vent 59 to vent air for filling of the outer container.

Figure 3:
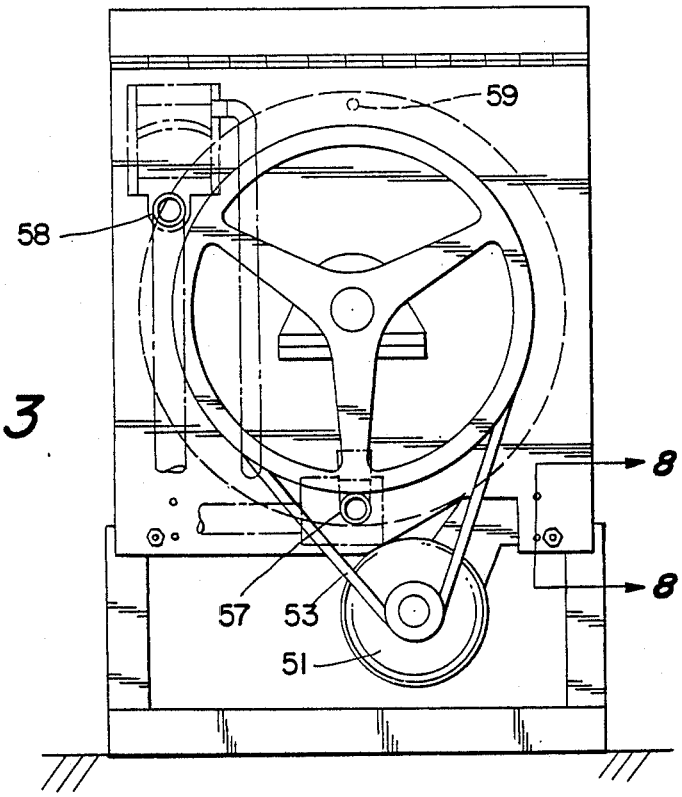
FIG. 3 is a rear elevational view of the machine.
Figure 9:
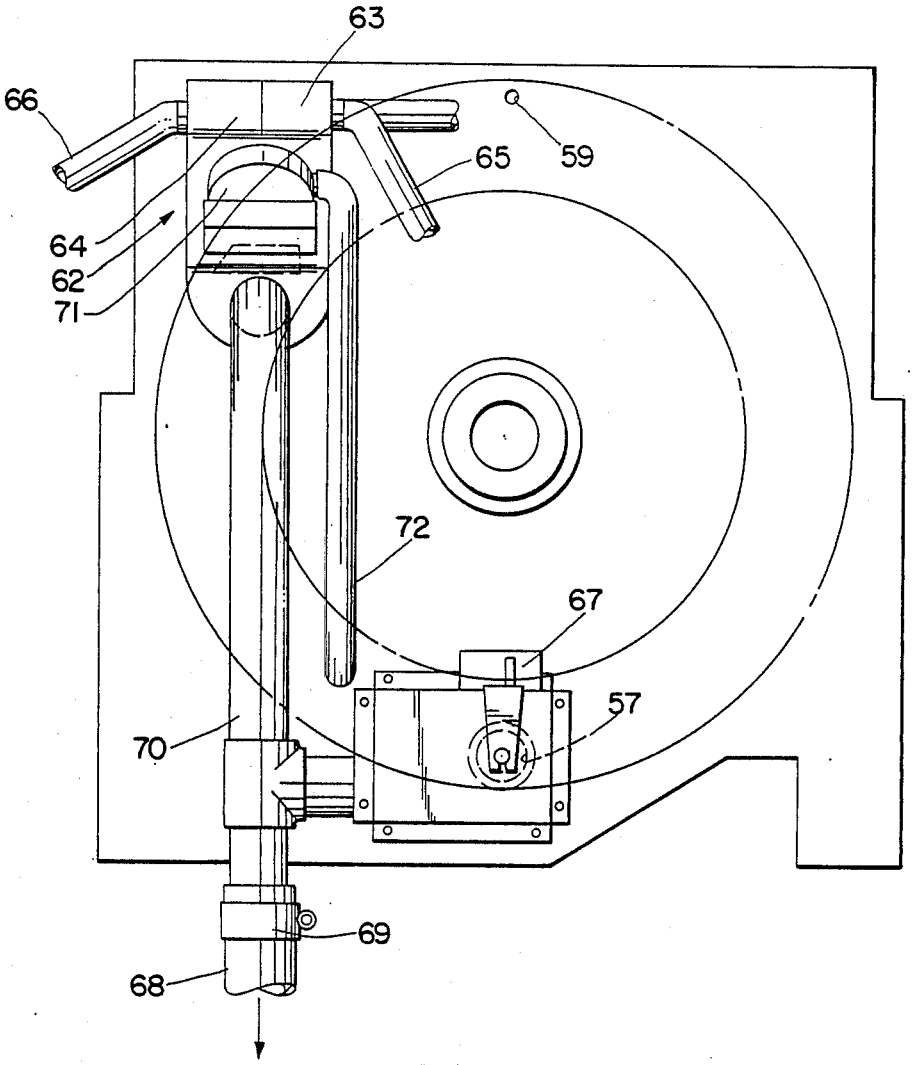
FIG. 9 is a more detailed rear elevational view.

A value housing 62, FIGS. 1 and 9, is secured to the rear plate 23 and, in the preferred embodiment, is in the top thereof. This valve housing includes a hot water fill valve 63 and a cold water fill valve 64, each of which may be solenoid-operated. The fill valves 63 and 64 control fluid inlet through flexible hoses 65 and 66 to the fill valves 63 and 64, and thence into the outer container 25. A solenoid-actuated drain valve 67 controls actuation of the drain 57 through a flexible drain hose 68 to a suitable drain, such as a sewer connection. A quick-release clamp 69 connects the flexible drain hose 68 to the drain 57. The overflow 58, FIG. 3, is also connected to this same sewer connection by a conduit 70.

A diaphragm switch 71, FIG. 9, is mounted on the valve housing 62, and is controlled by a water level conduit 72 connected to the lower end of the outer container 25.

An access door 73 is hinged to the lower edge of the front of the base 13 and may be closed, as shown in FIG. 1, or opened, as shown in FIG. 2. When opened, it opens an interlock switch 74. Also, when opened, this gives access to a quick-disconnect connection 75 in a flexible cable 76 supplying power to the motor 51. A control unit 78 may be mounted in a convenient location for control of the cleaning machine 12. This may be a coin-operated unit if the cleaning machine is to be used in a commercial laundry or in an apartment house, for example, or merely may be a timer or electrical controls where used in a home laundry. The control unit 78 may be mounted in any number of conveniently accessible locations. FIG. 1 shows the control unit mounted just to the rear of an upper panel 79 of the cabinet 15, or an alternate location is shown in FIG. 4 which is mounted on the front plate 24 on either side of the outer container 25. Also, such control unit may be mounted on the inside of the access door 73, especially in home laundry units.

OPERATION

The control unit 78 may be actuated to start operation of the cleaning machine 12 in a usual manner. Where the cleaning machine is used as a washing machine, the fill valves 63 and 64 will cause filling of the outer container to a suitable depth, and then of the perforated container 29 for short time periods in alternate directions. After the washing cycle has been completed, the drain valve 67 will be actuated to drain the outer container and the motor will go into high speed for centrifugally extracting the liquid. The present invention provides front servicing for this cleaning machine 12, which is highly advantageous where the cleaning machine is one of a row of such machines in a commercial laundry or is an undercounter unit or the lower unit of a stacked unit. In all such cases, access to the drive mechanism 50 would be quite difficult except for the present invention. For servicing, the access door 73 may be opened to the position shown in FIG. 2, and the four removable bolts 43 and 46 are quite accessible for removal by a wrench. With these removed, the cleaning machine unit 18 is still in a stable condition because the center of gravity CG is to the rear of the pivots 19 and 20. The opening of the access door 73 opens the interlock switch 74, which may be connected to de-energize all of the electrical power inside the cleaning machine 12, so that it may be safely worked on by the serviceman. This serviceman may reach through the access door 73 to disconnect the electric plug to the motor 51 at the connection 75, in case the flexible cable 76 is not long enough to permit tipping to the FIG. 2 position. If it is long enough, then this disconnection need not be made. The serviceman may also reach through the access door 73 to actuate the quick-release clamp 69 to disconnect the flexible drain hose 68 from the conduit 70. The flexible hoses 65 and 66 are long enough and have enough slack to permit tipping of the cleaning machine unit 18 from the position of FIG. 1 to the servicing position of FIG. 2. In this position, the center of gravity CG of the cleaning machine unit has rotated about 90 degrees from a position above and to the rear of the pivots 19, 20 to a position forward and above the pivots 19,20. This makes the cleaning machine unit 18 again in a stable condition so that it may be serviced without fear of flipping back to the FIG. 1 position. In this FIG. 2 position, the drive mechanism 50 is on the upper portion of the cleaning machine unit 18, so that the motor 51 may be serviced or replaced if necessary, the bearings 32 lubricated if such is required, or the belt 53 replaced. Alternatively, the motor 51 may be removed or replaced while the unit is in the upright position of FIG. 1, through the access door 73. This is still front service of the machine 12. Also, the journal means 30 is readily exposed on the upper side of the rear plate 23 should this need to be rebuilt or serviced in any manner.

The change in position from FIG. 1 to FIG. 2 shows that the cleaning machine 12 is one which is readily operable in a normal manner for cleaning clothes or washing clothes and the like, yet may be tipped from a substantially vertical position of the front door to a substantially horizontal position of the front door, to thus expose the drive mechanism on the rear plate to a forward and upper position of the unit for servicing.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A front loading cleaning machine comprising, in combination:

a base adapted to be stationary;

a cleaning machine unit having a watertight outer container;

a perforated container within said outer container;

means journaling said perforated container in said outer container;

a front loading door on said outer container providing access to the interior of said perforated container;

a drive mechanism including an electric motor and a drive connection from said motor to rotate said perforated container; and a pivot connection between said base and said cleaning machine unit along a horizontal pivot line parallel to the front door of said unit, whereby said unit may be tipped from a substantially vertical position of said front door forwardly to a substantially horizontal position of said front door to thus expose said drive mechanism on an upper portion of said unit.

2. The front loading cleaning machine as set forth in claim 1, including a front plate and a rear plate on said cleaning machine unit substantially parallel, and said front door being on said front plate.

3. The front loading cleaning machine as set forth in claim 1, wherein said outer container is substantially cylindrical.

4. The front loading cleaning machine as set forth in claim 1, wherein said perforated container is substantially cylindrical with an open front.

5. The front loading machine as set forth in claim 1, including a rear plate in said unit; and said journaling means including a bearing housing on said rear plate and a shaft on said perforated container.

6. The front loading cleaning machine as set forth in claim 1, wherein said drive mechanism includes a drive pulley on said electric motor, and a belt from said drive pulley to rotate said perforated container.

7. The front loading cleaning machine as set forth in claim 6, including a rear plate on said unit, and means to mount said electric motor on said rear plate to have said motor tip with said rear plate.

8. The front loading cleaning machine as set forth in claim 7, including a driven pulley on said perforated container, and said belt engaging said driven pulley.

9. The front loading cleaning machine as set forth in claim 1, wherein said horizontal pivot line is below and to the rear of the center of gravity of said perforated container.

10. The front loading cleaning machine as set forth in claim 1, wherein said horizontal pivot line is below and forward of the center of gravity of said cleaning machine unit, with the front door in a substantially vertical position, for a stable position.

11. The front loading cleaning machine as set forth in claim 10, wherein said horizontal pivot line is below and to the rear of the center of gravity of said cleaning machine unit, with the front door in a substantially horizontal position, for a stable position.

12. The front loading cleaning machine as set forth in claim 1, wherein said horizontal pivot line extends through said outer container.

13. The front loading cleaning machine as set forth in claim 1, including a cabinet substantially enclosing said cleaning machine unit and having an open front generally parallel with said front door.

14. The front loading cleaning machine as set forth in claim 1, including electrical wiring to said electric motor; and a disconnectable plug in said electric wiring to permit tipping of said cleaning machine unit.

15. The front loading cleaning machine as set forth in claim 1, including a drain from said outer container; and a disconnectable coupling in said drain capable of being disconnected for tipping of said cleaning machine unit.

16. The front loading cleaning machine as set forth in claim 15, including an access door on said base below said front door, the opening of said access door permitting access to said disconnectable drain coupling.

17. The front loading cleaning machine as set forth in claim 16, including an interlock switch on said access door controlling electrical power to said electrical motor.

18. The front loading cleaning machine as set forth in claim 16, including threaded fasteners interengaging said base and said cleaning machine unit; and Said threaded fasteners being accessible through said access door for removal to permit tipping of said cleaning machine unit.

19. The front loading cleaning machine as set forth in claim 1, including a rear plate on said unit; hot and cold water fill valves on said rear plate; and flexible hoses from said fill valves to hot and cold water sources to permit tipping of said cleaning machine unit.

20. The front loading cleaning machine as set forth in claim 1, including an access door on said base below said front door; and said motor capable of being removed through said access door with said machine unit in the normal upright position.

* * * * *

UNITED STATES PATENT AND TRADEMARK OFFICE

CERTIFICATE OF CORRECTION

PATENT NO. : 4,819,459

DATED : April 11, 1989

INVENTOR(S) : John R. Keith

It is certified that error appears in the above-identified patent and that said Letters Patent is hereby corrected as shown below:

Col. 2, line 57 "30" should be --20--.

Col. 4, line 2, after "then" add --agitation of the clothing by rotation at a low speed--.

Signed and Sealed this

Thirty-first Day of October, 1989

*Attest:*

DONALD J. QUIGG

*Attesting Officer*

*Commissioner of Patents and Trademarks*